US009523308B2

(12) United States Patent
Candela et al.

(10) Patent No.: US 9,523,308 B2
(45) Date of Patent: Dec. 20, 2016

(54) OIL DRAIN PLUG AND SOCKET

(71) Applicant: GM GLOBAL TECHNOLOGY OPERATIONS LLC, Detroit, MI (US)

(72) Inventors: Giorgio Candela, Turin (IT); Luca Agatau, Turin (IT); Gaetano Esposito, Naples (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 10 days.

(21) Appl. No.: 14/626,110

(22) Filed: Feb. 19, 2015

(65) Prior Publication Data

US 2015/0240677 A1 Aug. 27, 2015

(30) Foreign Application Priority Data

Feb. 21, 2014 (GB) ..... 1403159.5

(51) Int. Cl.
*F01M 11/04* (2006.01)
*F01P 11/02* (2006.01)
*F01M 11/00* (2006.01)

(52) U.S. Cl.
CPC ..... *F01P 11/0276* (2013.01); *F01M 11/0004* (2013.01); *F01M 11/0408* (2013.01); *F01M 2011/0416* (2013.01)

(58) Field of Classification Search
CPC ..... F01M 11/0408; F01M 11/0004; F01M 2011/0416; F16B 43/001; F01P 11/0276
USPC ..... 184/1.5
See application file for complete search history.

(56) References Cited

U.S. PATENT DOCUMENTS 1,954,986 A 4/1934 Carlson et al.
4,231,544 A * 11/1980 Balch ..... F01M 11/0408 137/351
4,679,618 A * 7/1987 Farkas ..... F01P 11/0276 165/71
4,717,119 A * 1/1988 Trin ..... F01P 11/0276 220/300
5,096,158 A * 3/1992 Burdick ..... F01M 11/0408 137/315.25

(Continued)

FOREIGN PATENT DOCUMENTS

DE 102009055158 A1 6/2011
WO 2010017867 A9 2/2010

OTHER PUBLICATIONS

UKIPO, Great Britain Search Report for GB1403159.5, dated Sep. 29, 2014.

*Primary Examiner* — Michael Riegelman
(74) *Attorney, Agent, or Firm* — Lorenz & Kopf LLP

(57) ABSTRACT

An oil drain plug is disclosed for cooperating with a socket in an oil sump. The plug includes a main body, an eccentric pin protruding from the main body, and an enlarged tip on an end of the eccentric pin. The socket includes a cup-shaped cavity having a lateral wall open at one end, closed at the opposite end by a bottom wall and including an internal surface for mating with the main body of the plug. The bottom wall includes an external surface facing outside the cavity, a through hole such that the enlarged tip of the plug extends beyond the external surface, and a slot departing from the through hole towards a distal end along an arched path centered in the axis and having a smaller width than the through hole for preventing the enlarged tip of the plug from passing through it.

14 Claims, 6 Drawing Sheets

(56) References Cited

U.S. PATENT DOCUMENTS

| | | | | |
|---|---|---|---|---|
| 5,628,601 | A * | 5/1997 | Pope | F01M 11/0408 138/89 |
| 5,722,451 | A * | 3/1998 | Godeau | F01P 11/0276 137/315.01 |
| 2006/0022165 | A1* | 2/2006 | Ciesielka | F16K 1/50 251/344 |
| 2008/0000724 | A1 | 1/2008 | Stlaske et al. | |
| 2010/0006376 | A1* | 1/2010 | Jessberger | F01M 11/0408 184/1.5 |

* cited by examiner

OIL DRAIN PLUG AND SOCKET

CROSS-REFERENCE TO RELATED APPLICATION

This application claims priority to British Patent Application No. 1403159.5, filed Feb. 21, 2014, which is incorporated herein by reference in its entirety.

TECHNICAL FIELD

The present disclosure generally relates to an oil drain plug and to a socket for cooperation with that plug, and more particularly to an oil drain plug and socket for an oil sump of an internal combustion engine.

BACKGROUND

It is known that an internal combustion engine conventionally includes an engine block defining a number of cylinders. Each cylinder accommodates a piston that is coupled to a crankshaft and cooperates with a cylinder head to define a combustion chamber. A fuel and air mixture is cyclically injected into the combustion chamber and ignited, resulting in hot expanding exhaust gasses causing reciprocal movement of the piston and thus rotation of the crankshaft.

During operation, the rotating and sliding components of the internal combustion engine are lubricated through a lubricating circuit. The lubricating circuit conventionally includes an oil sump fastened at the bottom of the engine block and an oil pump that draws motor oil from the engine sump and delivers it under pressure through a plurality of lubricating channels internally defined by the engine block and the cylinder head. An oil cooler is provided for cooling down the motor oil, once it has passed through the lubricating channels and before it returns to the oil sump. The lubricating channels usually include a main oil gallery internally defined by the engine block, whence the motor oil is directed towards a plurality of exit holes for lubricating many movable components of the internal combustion engine, before returning in the oil sump. These movable components include, but are not limited to, crankshaft bearings (main bearings and big-end bearings), camshaft bearings operating the valves, tappets and the like.

Due to this circulation, the motor oil is exposed to products of the internal combustion, such as microscopic coke particles, as well as to microscopic metallic particles produced by the rubbing of metal engine parts. Such particles may accumulate in the motor oil and grind against the part surfaces causing wear. In addition, the motor oil undergoes thermal and mechanical degradation, which progressively reduce its viscosity and reserve alkalinity. At reduced viscosity, the motor oil is not capable of lubricating the engine properly, thus increasing wear and chance of overheating. Reserve alkalinity is the ability of the motor oil to resist formation of acids. Should the reserve alkalinity decline to zero, those acids may form and corrode the engine.

For all these reasons the motor oil needs to be periodically replaced. To allow this replacement, the oil sump is usually provided with an oil drain plug that can be removed to discharge the waste oil. A standard oil drain plug is shaped as in a screw-like fashion having a cylindrical portion provided with an external thread, and a head formed at one end of the cylindrical portion for allowing the plug to be turned. This oil drain plug is screwed into a draining hole that fluidly connects the internal volume of the oil sump with the outside. In particular, the draining hole is located at the bottom of the oil sump so that, once the oil drain plug has been removed, the motor oil can flow spontaneously outside under the gravity force.

This standard oil drain plug is conventionally made of metal, because it was originally designed to be used with metallic oil sumps, for example with oil sumps made of stamped sheet metal or aluminum casting. However, some of the modern oil sumps need to be made of plastic, in order to reduce the cost and the weight of the internal combustion engines. In these cases, the screwing and unscrewing of the metallic plug during service operations could damage the thread of the draining hole. Therefore, to keep on using standard oil drain plugs, the draining hole of plastic oil sumps should be internally lined with a metallic insert. As a side effect, the metallic material of the insert would have a different thermal expansion with respect to the plastic material of the oil sump. Therefore, since the oil temperature inside the oil sump may increase up to 150° C., the different thermal expansion could cause oil leakages at the plastic/metal interface. To prevent such oil leakages, an additional gasket, typically a Press-In-Place (PIP) gasket, should to be interposed between the metallic insert an the plastic part of the oil sump.

In view of the above, it clearly turns out that the presence of a metallic insert and of a PIP gasket will complicate the manufacturing of the plastic oil sumps, thereby increasing the cost and the assembly cycle time. In addition, other objects, desirable features and characteristics will become apparent from the subsequent summary and detailed description, and the appended claims, taken in conjunction with the accompanying drawings and this background.

SUMMARY

In accordance with the present disclosure an oil drain plug is provided that, in cooperation with a correspondent socket, is more simple and cost effective than the standard plugs, while continuing to guarantee an efficient sealing of the oil sump during engine operation. The oil drain plug and socket may be both made of the same material, thereby reducing the chance of oil leakages due to their thermal behavior and provides a simple, rational and inexpensive solution.

An embodiment of the present disclosure provides an oil drain plug including a main body shaped as a solid of revolution having a central axis, an eccentric pin protruding cantilevered from an end surface of the main body and eccentrically with respect to the central axis thereof, and an enlarged tip located at the free end of the eccentric pin. The oil drain plug can be engaged and fastened in a corresponding socket by means of a bayonet mount, which does not involve any screw threads or the like. In this way, the manufacture of the oil drain plug is simpler than that of the standard oil drain plug. In particular, the oil drain plug of this embodiment may be made of plastic, thereby reducing the change of oil leakages on plastic components, such as for example on plastic oil sump. As a result, there may be no need of additional PIP gaskets or the like, thereby reducing the number of components and so the cost and the assembly cycle time of the oil drain plug and socket assembly.

According to an aspect of the present disclosure, the oil drain plug may include a flange protruding radially from the main body at the opposite end thereof with respect to the eccentric pin. This flange advantageously defines an abutment that may be useful to limit the axial displacement of the oil drain plug into the correspondent socket.

According to another aspect of the present disclosure, the oil drain plug may include a spring surrounding the main body and resting on the flange. In this way, once the oil drain plug has been engaged with the corresponding socket, the spring washer may be compressed between the mouth of the socket and the flange, thereby exerting on the oil drain plug an elastic force that tend to keep the latter engaged with the socket.

According to another embodiment, the oil drain plug may include an annular gasket encircling the main body. This annular gasket has the advantage of guaranteeing the sealing between the oil drain plug and the correspondent socket.

According to another aspect of the present disclosure, the annular gasket may be seated in an annular groove of the main body. In this way, the annular gasket becomes integral with the oil drain plug and can be more easily replaced if worn.

According to another aspect of the present disclosure, the enlarged tip of the eccentric pin may be ball shaped. This shape of the enlarged tip has the advantage of making smoother the rotation of the oil drain plug inside the socket during their mutual engagement.

According to another aspect of the present disclosure, the main body may include at least a cylindrical portion. In other words, the main body may be a cylinder or include a number of cylindrical coaxial portions having different diameters. In this way, the shape of the main body turns out quite simple and thus easy to manufacture.

Another embodiment of the present disclosure provides a socket for cooperation with the oil drain plug disclosed above, which includes a cup-shaped cavity delimited by a lateral wall open at one end (mouth) and closed at the opposite end by a bottom wall. The lateral wall includes an internal surface shaped as a surface of revolution for mating with the main body of the plug. The bottom wall includes an external surface facing outside the cavity, a through hole realized eccentrically with respect to the axis of the internal surface for letting the enlarged tip of the plug jut out beyond the external surface, and a slot departing from the through hole and extending towards a distal extremity along an arched path centered in the axis of the internal surface. The slot has a smaller width than the through hole for preventing the enlarged tip of the plug from passing through it.

This socket has the advantage of cooperating with the oil drain plug to achieve a reliable oil retaining system, which does not involve any screw threads or the like. In this way, the manufacture of the socket is simpler than that of the standard ones. In particular, the socket of this embodiment of the present disclosure may be made of plastic, without the need of any reinforcing metal inserts.

According to an aspect of the present disclosure, the bottom wall of the socket may further include a hollow seat realized on the external surface and located at the distal extremity of the slot for accommodating the enlarged tip of the plug. This hollows seat has the advantage of retaining the oil drain plug in engagement with the socket.

According to another aspect of the present disclosure, the external surface of the bottom wall may be inclined so that its distance from the open end of the cavity decreases from the through hole towards the distal extremity of the slot. This aspect of the present disclosure has the advantage of reducing the chance of accidental disengagement between the oil drain plug and the socket. In fact, to disengage them, it is necessary not only to rotate the oil drain plug, but also to push it axially deep inside the socket cavity.

Accidental disengagements are particularly unlikely when the spring is provided between the flange of the oil drain plug and the socket mouth, because such spring exerts an elastic force that push the oil drain plug outwards and, thanks to the slope of the bottom wall, tends to move the enlarged tip of the drain plug towards the distal end of the socket slot.

According to another aspect of the present disclosure, the lateral wall of the socket may include at least a through opening. In this way, once the oil drain plug has been removed, the oil can flow through this opening towards the open mouth of the socket, whence it can be discharged and eventually collected.

According to another aspect of the present disclosure, the internal surface of the lateral wall may include at least a cylindrical portion. In other words, the internal surface may be a cylinder or include a number of cylindrical coaxial portions having different diameters. In this way, the shape of the internal surface is quite simple, thereby making the socket easy to manufacture.

Another embodiment of the present disclosure provides an oil drain plug and socket assembly that includes the socket and the oil drain plug disclosed above, wherein the plug is engagable in the socket. This embodiment of the present disclosure achieves essentially the same advantages mentioned before in relation to the cooperation of the proposed oil drain plug with the correspondent socket.

The present disclosure may also be embodied as an oil sump including the oil drain plug and socket assembly. By way of example, the socket may be manufactured in a single body with the oil sump. The present disclosure may eventually be embodied as an internal combustion engine including the oil sump. Taking advantage of the proposed oil drain plug and socket assembly, these embodiments of the present disclosures achieve reduce the cost and the assembly cycle time respectively of the oil sump and of the internal combustion engine.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the present disclosure or the application and uses of the present disclosure. Furthermore, there is no intention to be bound by any theory presented in the preceding background of the present disclosure or the following detailed description.

Figure 1:
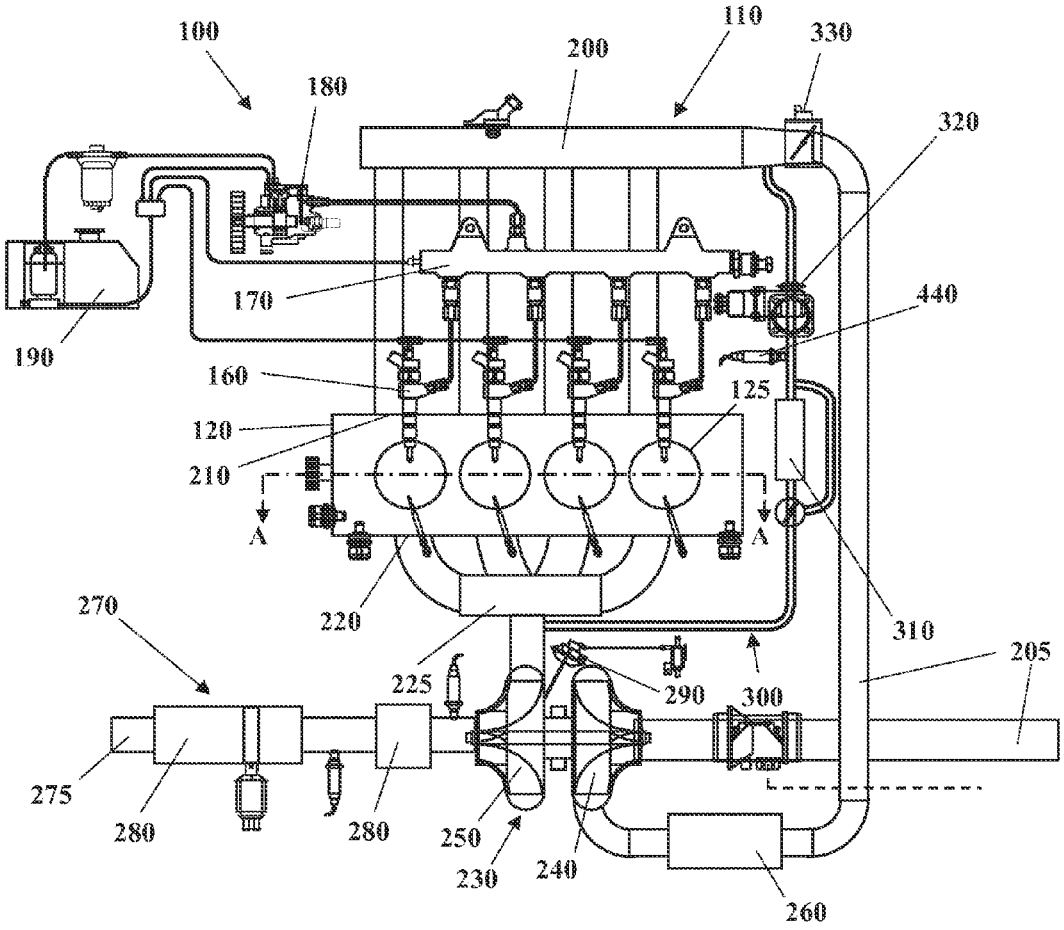
FIG. 1 schematically shows an automotive system.
Figure 2:
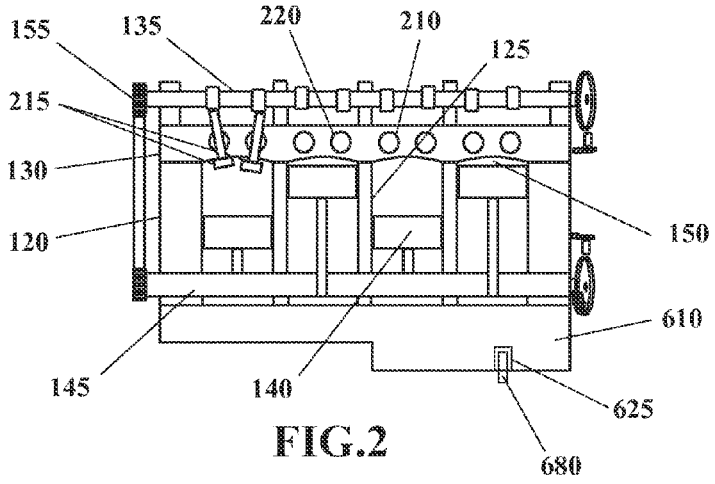
FIG. 2 is section A-A of FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150. A fuel and air mixture (not shown) is injected in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increase the pressure of the fuel received from a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust system 270 may include an exhaust pipe 275 having one or more exhaust after treatment devices 280. The after treatment devices may be any device configured to change the composition of the exhaust gases. Some examples of after treatment devices 280 include, but are not limited to, catalytic converters (two and three way), oxidation catalysts, lean NOx traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

Figure 3:
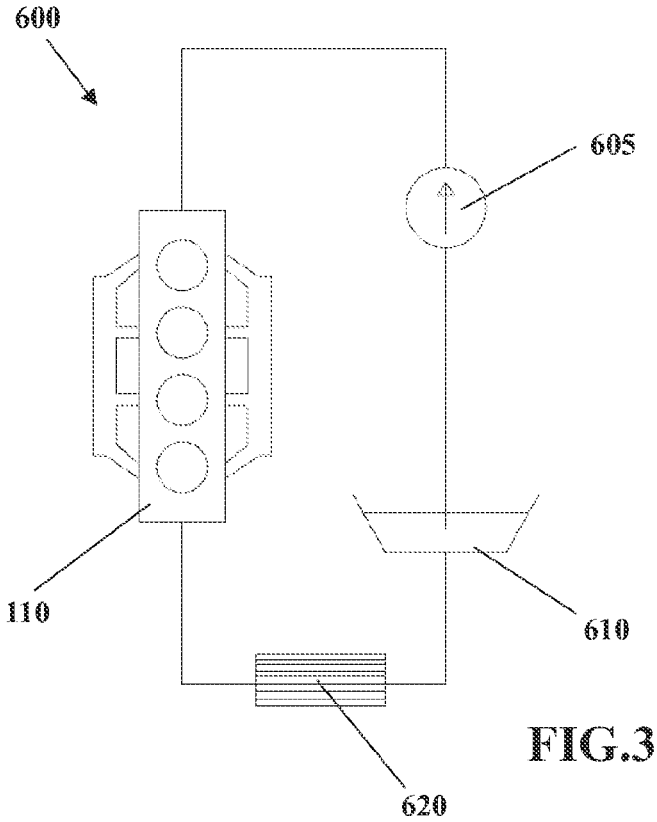
FIG. 3 schematically shows a lubricating circuit of the automotive system of FIG. 1.

As shown in FIG. 3, the automotive system 100 may further include an engine lubricating circuit 600 for lubricating the rotating and sliding parts of the ICE 110. The engine lubricating circuit 600 includes an oil pump 605 that draws lubricating oil (i.e. motor oil) from an oil sump 610 and delivers it under pressure through a plurality of lubricating channels (not visible) internally defined by the engine block 120 and by the cylinder head 130. An oil cooler 620 may be provided for cooling down the motor oil, once it has passed through the lubricating channels and before it returns to the oil sump 610. The oil sump 610 may be fastened directly at the bottom of the engine block 120 as shown in FIG. 2. The lubricating channels usually include a main oil gallery internally defined by the engine block 120, whence the motor oil is directed towards a plurality of exit holes for lubricating many movable components of the ICE 110, before returning in the oil sump 610. These ICE movable components include, but are not limited to, crankshaft bearings (main bearings and big-end bearings), camshaft bearings operating the valves, tappets and the like.

The oil sump 610 may be made of plastic, in order to reduce the cost and the weight of the ICE 110. The oil sump 610 may also include a socket 625 (see FIG. 2) that is configured to define a fluid connection from the internal volume to the outside, in order to allow the motor oil to be discharged when dirty and/or degraded. In particular, the socket 625 is located at the bottom of the oil sump 610, so that the wasted motor oil can flow spontaneously outside under the gravity force. The socket 625 may be made of plastic, for example it may be realized in a single body with the oil sump 610.

Figure 6:
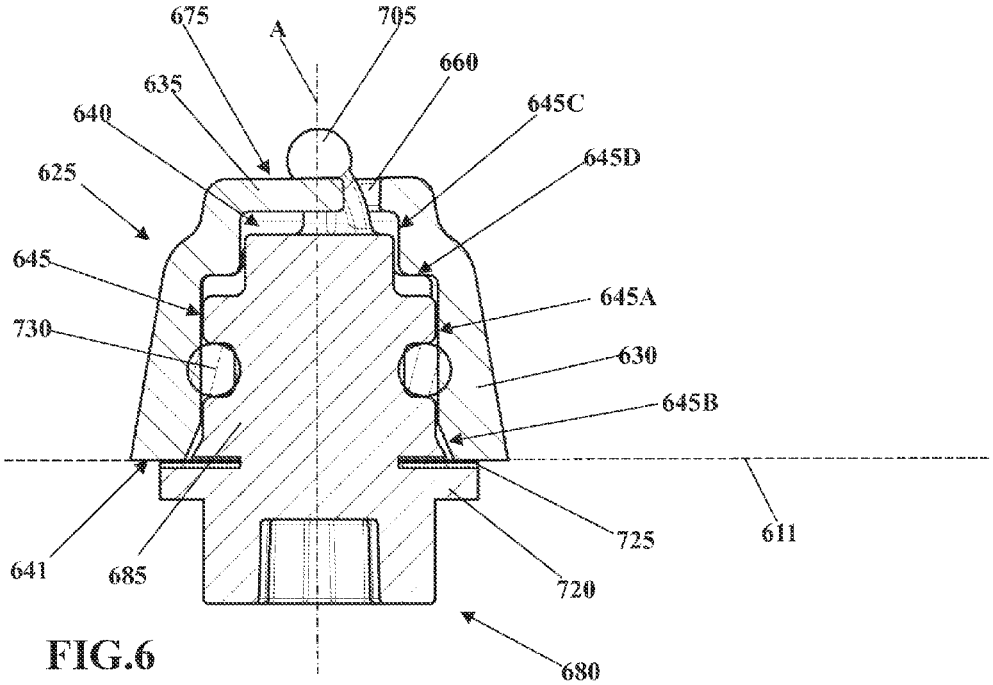
FIG. 6 is section VI-VI of FIG. 5.

In this example (see FIG. 6), the socket 625 includes a substantially tubular lateral wall 630 having a straight central axis A. The lateral wall 630 is open at one end and closed at the opposite end by a bottom wall 635. In particular, the lateral wall 630 may project from the external surface 611 of the oil sump 610 towards the inside, so that the bottom wall 635 may be located within the internal volume of the oil sump 610. The lateral wall 630 and the bottom wall 635 together delimit a cup-shaped cavity 640, whose open mouth 641 (i.e. the open end of the lateral wall 630) lies on the external surface 611 of the oil sump 610. More precisely, the cup-shaped cavity 640 is delimited by the internal surface 645 of the lateral wall 630, which is shaped as a surface of revolution with respect to the central axis A. In the present example, the internal surface 645 particularly includes a first cylindrical portion 645A that is located next to the open mouth 641 of the cavity 640 and is connected to the external surface of the oil sump 610 by an annular chamfer 645B. The internal surface 645 further includes a second cylindrical portion 645C that is coaxial to the first cylindrical portion 645A and is interposed between the latter and the bottom wall 635. The second cylindrical portion 645C has a diameter smaller than the diameter of the first cylindrical portion 645A, to which is connected by a radial abutment 645D.

Figure 4:
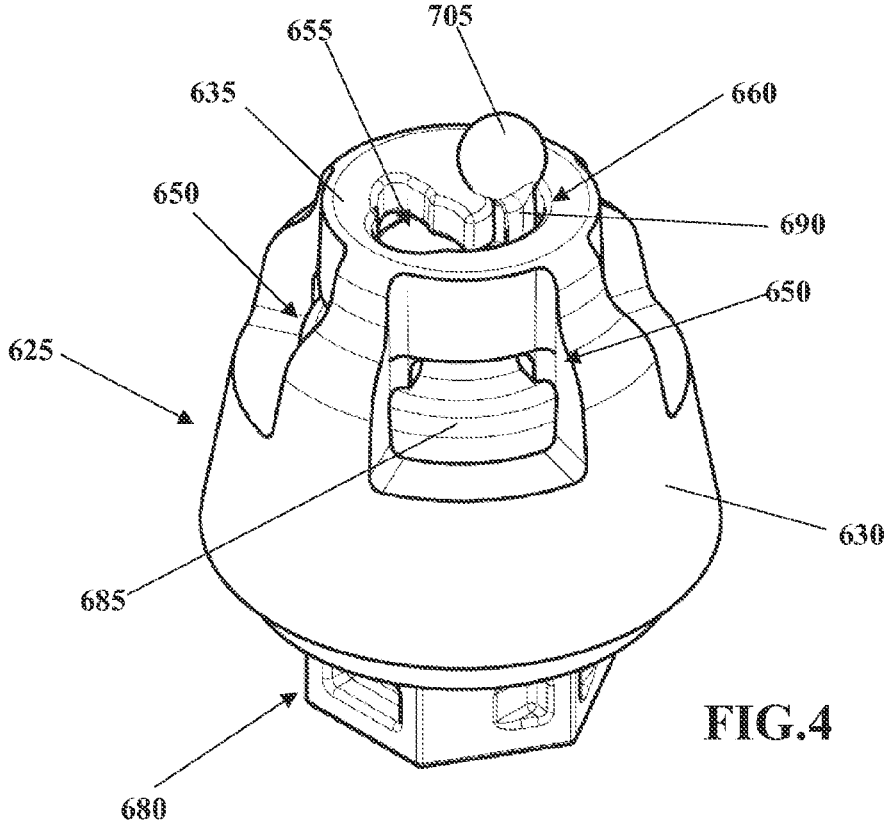
FIG. 4 is an axonometric view of an oil drain plug and socket assembly associated to an oil sump of the lubricating circuit of FIG. 3.
Figure 5:
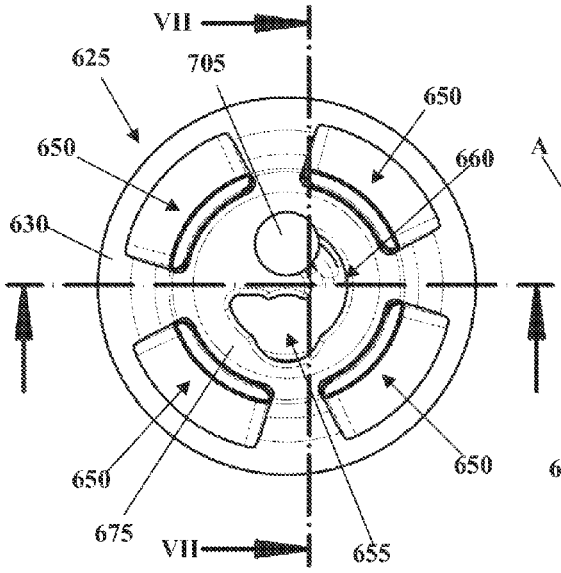
FIG. 5 is a top view of the oil drain plug and socket assembly of FIG. 4.
Figure 7:
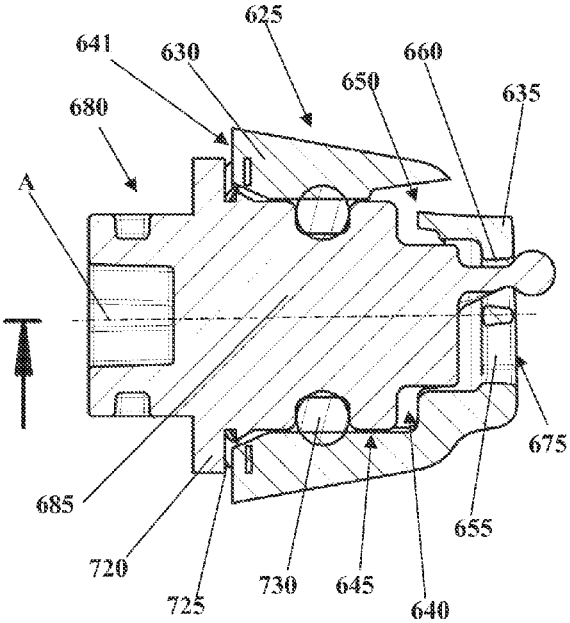
FIG. 7 is section VII-VII of FIG. 5.

Next to the bottom wall 635, the lateral wall 630 is provided with one or more through openings 650 (see FIGS. 4, 5 and 7) that fluidly connect the cup-shaped cavity 640 with the internal volume of the oil sump 610. These through openings 650 are distributed around the central axis A, angularly equidistant one another. The axial extension of each through opening 650 occupies only a limited portion of the length of the lateral wall 630, in the example almost only the second cylindrical portion 645C.

The socket 625 is further provided with a through hole 655 and with a through slot 660 that are realized in the bottom wall 635. The through hole 655 is eccentric with respect to the central axis A. The slot 660 departs from the through hole 655 and extends towards a distal extremity 665 thereof (see FIG. 13), along an arched path centered in the central axis A. The width of the slot 660 (i.e. its radial dimension with respect to the central axis A) is smaller than the width (e.g. the diameter) of the through hole 655. The distal extremity 665 of the slot 660 is bounded by a hollow seat 670 (schematically depicted also in FIGS. 15 and 16), which is realized on the external surface 675 of the bottom wall, namely the surface facing the inside of the oil sump 610, on the opposite side of the cup-shaped cavity 640. In particular, this external surface 675 is substantially flat and is inclined with respect to the central axis A, in such a way that its distance from the open mouth 641 of the cup-shaped cavity 640 decreases from the through hole 655 towards the distal extremity 665 of the slot 660 (see also FIG. 7). By way of example, the slope of the external surface 675 may be of about 3 degrees.

The oil sump 610 is further equipped with an oil drain plug 680 that is engagable with the socket 625 for closing the fluid communication between the internal volume of the sump 610 and the outside. The oil drain plug 680 may be made of plastic, for instance of the same plastic material of the socket 625, in order to be lightweight and have the same thermal behavior. As shown in FIGS. 9-12, the oil drain plug 680 includes a main body 685 shaped as a solid of revolution having a central axis B, for mating with the internal surface 645 of the cup-shaped cavity 640. In particular, the main body 685 includes a first cylindrical portion 685A and a second cylindrical portion 685B having a smaller diameter and protruding coaxially from the first cylindrical portion 685A, to which is connected by a radial abutment 685C. The first cylindrical portion 685A may have substantially the same diameter of the first portion 645A of the socket cavity 640, whereas the second cylindrical portion 685B may have substantially the same diameter of the second cylindrical portion 645C of the socket cavity 640.

The oil drain plug 680 further includes an eccentric pin 690 protruding cantilevered from an end surface 695 of the main body 685 (in the example, from the free end surface of the second cylindrical portion 685B) and eccentrically with respect to the central axis B. The eccentric pin 690 may be embodied as a small cylinder, whose axis is parallel to the central axis B. The radial distance between the central axis B and the eccentric pin 690 is substantially equal to the distance between the central axis A of the socket cavity 640 and the slot 660, while the diameter of the eccentric pin 690 is substantially equal to (or slightly smaller than) the width of the slot 660. A stiffening rib 700 may be provided for reinforce the eccentric pin 690, without increasing its radial dimension. The oil drain plug 680 further includes an enlarged tip 705 that is located at the free end of the eccentric pin 690. The enlarged tip 705 may be shaped as a ball having a bigger diameter than the eccentric pin 690. In particular, the diameter of the enlarged tip 705 may be substantially equal to (or slightly smaller than) the diameter of the through hole 655 of the socket 625, and the distance between the center of the enlarged tip 705 and the central axis B may be substantially equal to the distance between the center of the through hole 655 and the central axis A of the socket cavity 640.

Figure 8:
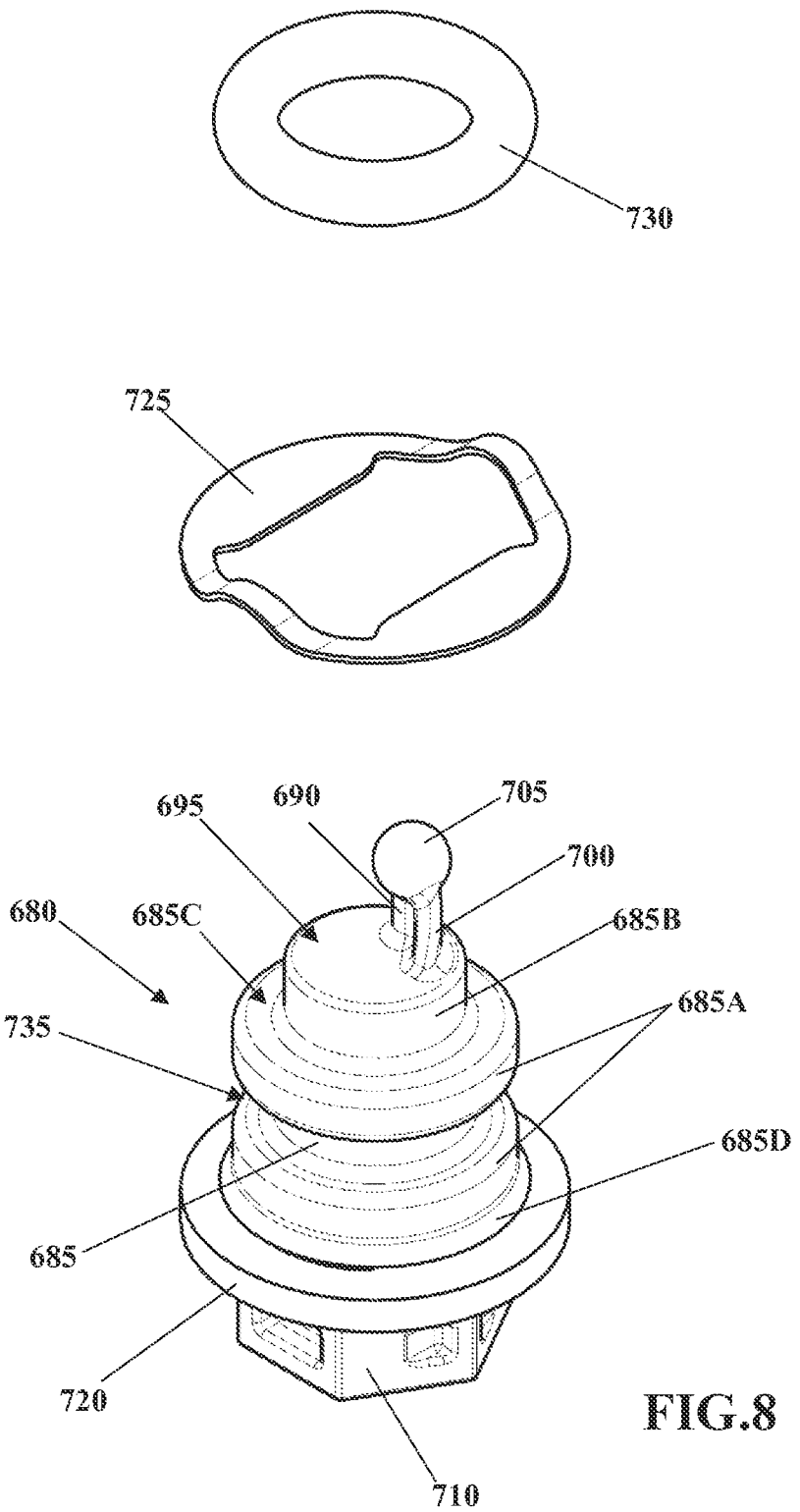
FIG. 8 is an exploded view of the oil drain plug of the assembly shown in FIG. 4.
Figure 9:
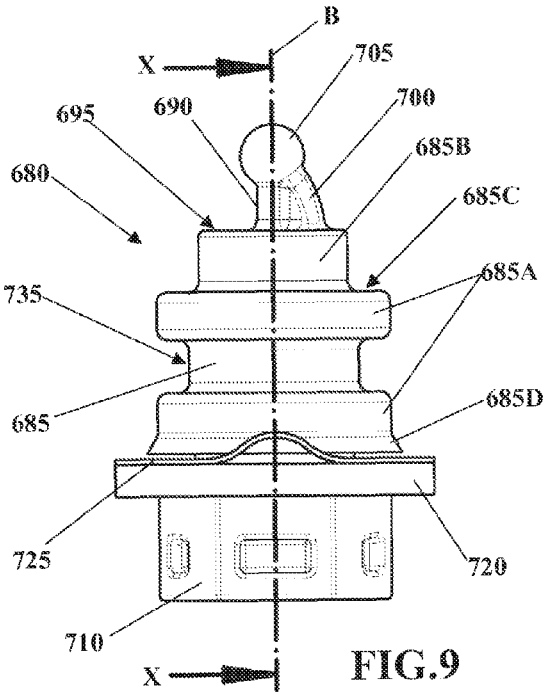
FIG. 9 is a lateral view of the oil drain plug of FIG. 8, shown without its gasket.
Figure 10:
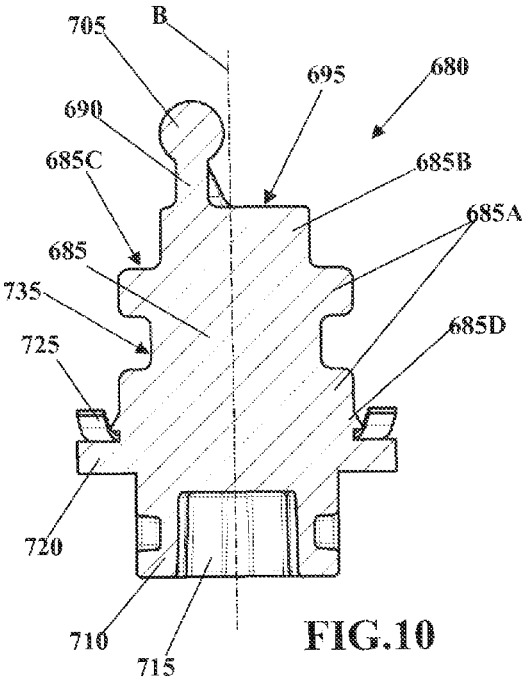
FIG. 10 is section X-X of FIG. 9.
Figure 11:
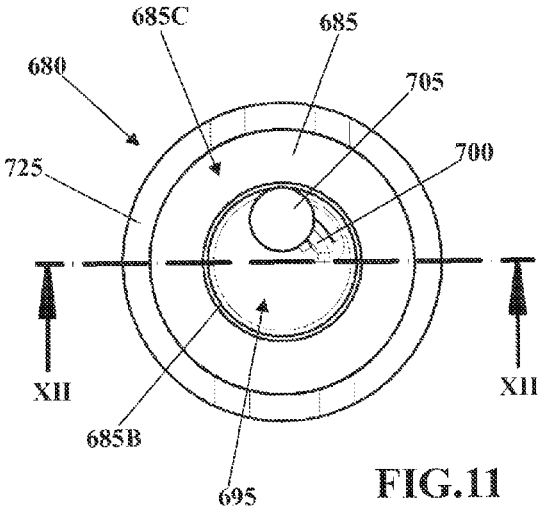
FIG. 11 is a top view of the oil drain plug of FIG. 9.
Figure 12:
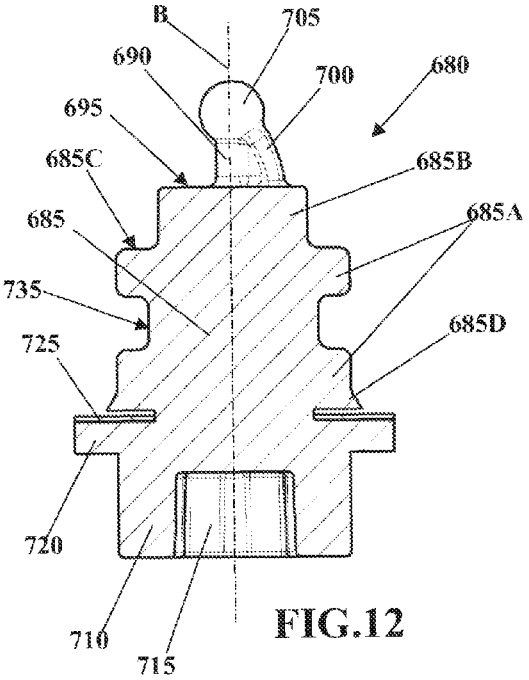
FIG. 12 is section XII-XII of FIG. 11.

The oil drain plug 680 may further include a coaxial head 710 formed at the opposite end of the main body 685 (with respect to the eccentric pin 690), for allowing the plug to be turned. In the example, the head 710 is a hexagonal head having also a hexagonal driving hole 715 in its center. Between the head 710 and the main body 685, the oil drain plug 680 may further include an annular flange 720 that protrudes radially from the main body 685 (in the example both from the head 710 and from the first cylindrical portion 685A), thereby defining a radial abutment. Resting on this radial abutment there may be a spring 725, in the example a spring washer that coaxially surrounds the main body 685. The spring 725 may be kept in this position by an annular rib 685D formed at the base of the first cylindrical portion 685A, which is tapered towards the second cylindrical portion 685B and is separated from the flange 720 by a narrow groove, where the spring 725 is blocked. The shape of the annular rib 685D substantially mates the chamfer 645B of the socket 625. Eventually, the main body 685 of the oil drain plug 680 may be encircled by an annular gasket 730 (see FIG. 8), in the example an O-ring, which is seated in an annular groove 735 coaxially realized in the main body 685, beyond the spring 725 with respect to the flange 720. In the example, the annular gasket 730 and the correspondent groove 735 are particularly located in the center of the first cylindrical portion 685A of the main body 685.

Figure 13:
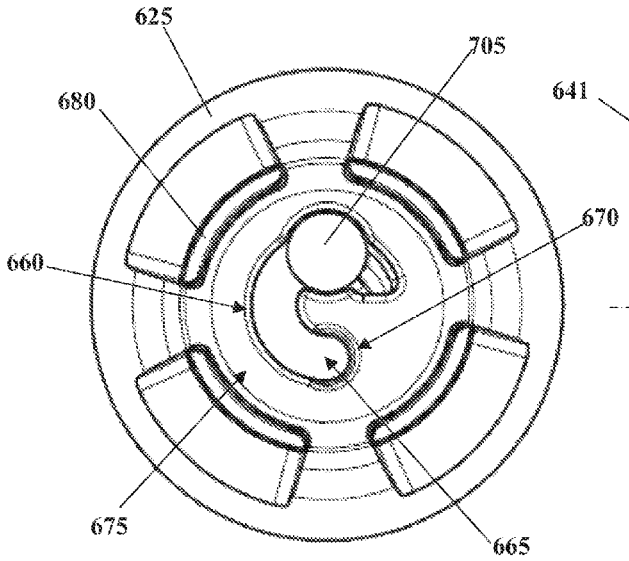
FIGS. 13 and 14 are top views of the oil drain plug and socket assembly of FIG. 4, shown for two different positions of the oil drain plug inside the socket.
Figure 15:
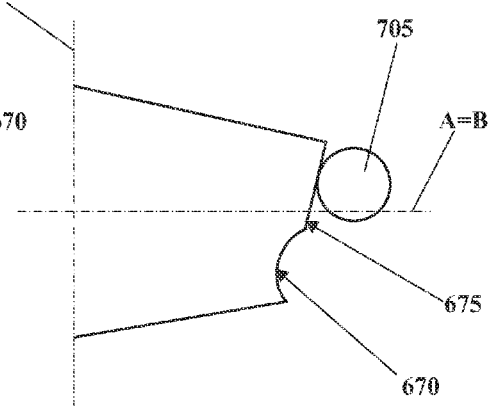
FIGS. 15 and 16 are schematic sketches showing the profile of the assembly of FIGS. 13 and 14 respectively.
Figure 14:
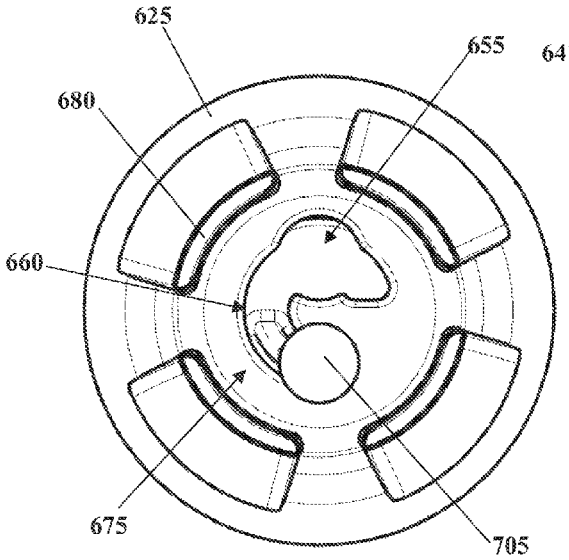
Figure 16:
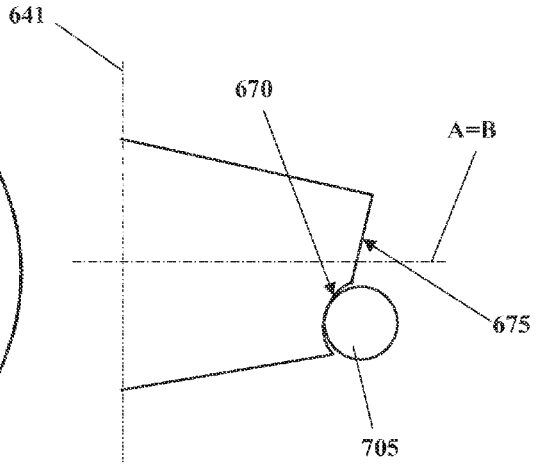

The oil drain plug 680 is engaged with the socket 625 by aligning the central axis B of the main body 685 with the central axis A of the cup-shaped cavity 640, oriented in such a way that the enlarged tip 705 is aligned with the trough hole 655, and then by moving axially the oil drain plug 680 to insert the main body 685 deep inside the cup-shaped cavity 640 (see FIGS. 13 and 15). The axial movement of the plug 680 goes on until the enlarged tip 705, passing through the hole 655, juts out beyond the external surface 675 of the bottom wall 635. During the movement, the spring 725 is compressed between the flange 720 of the oil drain plug 680 and the open mouth 641 of the socket 625, thereby generating an elastic force that tends to push the oil drain plug 680 towards the outside. Once the enlarged tip 705 completely extends beyond the external surface 675, the oil drain plug 680 will be rotated about its central axis B, so that the eccentric pin 690 slips into the slot 660 of the socket bottom wall 635. This rotation goes on for about 180 degrees, until the enlarged pin 705 is aligned with the hollow seat 670, where the oil drain plug 680 may remain (see FIGS. 14 and 16). In this position, the spring 725 continues to exert a certain elastic force that pulls and retains the enlarged pin 705 into the hollow seat 670. The reduced dimension of the slot 660 prevents the enlarged tip 705 from passing through it in axial direction, thereby blocking the oil drain plug 680 in engagement with the socket 625. In this mutual engagement, the main body 685 of the plug 680 mates the internal surface 645 of the socket 625, thereby plugging the through openings 650 that communicates with the oil sump 610. This plugging is made sealed by the annular gasket 730, which is radially compressed between the internal surface 645 of the cavity 640 and the main body 685 of the plug 680 (see FIGS. 6 and 7). Should the oil drain plug 680 exit from the hollow seat 670 and rotate towards the through hole 655, due for example to vibrations of the ICE 110, the slope of the external surface 675 of the bottom wall 635 would guide the enlarge tip 705 to return, under the biasing force of the spring 725, in the initial position, thereby reducing the chances of accidental disengagement of the oil drain plug 680. The same advantageous effect would also arise, if the operator does not completely rotate the oil drain plug 680 during the engagement operations. To deliberately open the oil sump 610, the operator have to rotate the oil drain plug 680 until its enlarge tip 705 is aligned with the through hole 655 and then draw the oil drain plug 680 axially outside the cup-shaped cavity 640 of the socket 625.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

The invention claimed is:

1. An oil drain plug comprising:

a main body formed by a side surface that is axisymmetric about a central axis and an end surface through which the central axis extends;

a pin having a first end and a second end, the pin fixed at the first end to the end surface and protruding cantilevered in an axial direction relative to the central axis, the pin being offset relative to the central axis; and an enlarged tip located at the second end of the pin; wherein the oil drain plug is configured for used with a socket, wherein the socket comprises: a cup-shaped cavity delimited by a lateral wall defining a complimentary internal surface for mating with the main body of the plug open at a first end; and a bottom wall formed at a second end opposite the first end of the cup-shaped cavity to form a closed end, the bottom wall having an external surface facing outside the cup-shaped cavity, a through hole positioned eccentrically with respect to the central axis such that the enlarged tip of the plug is configured to pass through the through hole and extend beyond the external surface upon the oil drain plug mating with the socket, and a slot departing from the through hole and extending towards a distal end along an arched path centered in the axis of the internal surface such that, after the enlarged tip of the plug passes through the through hole, the oil drain plug is configured for rotation such that the pin extends through the slot, the slot having a smaller width than a width of the through hole for preventing the enlarged tip of the plug from passing therethrough when the pin extends through the slot.

2. The oil drain plug according to claim 1, wherein the main body has a first d formed by the end surface and a second end opposite to the first end, the oil drain plug further comprising a flange protruding radially relative to the central axis from the main body at second end.

3. The oil drain plug according to claim 2, further comprising a spring surrounding the main body and resting on the flange.

4. The oil drain plug according to claim 1, further comprising an annular gasket encircling the main body.

5. The oil drain plug according to claim 4, wherein the annular gasket is seated in an annular groove of the main body.

6. The oil drain plug according to claim 1, wherein the enlarged tip comprises a spherical tip.

7. The oil drain plug according to claim 1, wherein the side surface of the main body further comprises a cylindrical portion.

8. The socket according to claim 1, wherein the bottom wall further comprises a hollow seat positioned on the external surface and located at the distal end of the slot for accommodating the enlarged tip of the plug.

9. The socket according to claim 8, wherein the external surface of the bottom wall is inclined so that its distance from the open end of the cavity decreases from the through hole towards the distal end of the slot.

10. The socket according to claim 1, wherein the lateral wall comprises a through opening.

11. The socket according to claim 1, wherein the internal surface of the lateral wall comprises a cylindrical portion.

12. An oil sump drain assembly comprising:

an oil plug having a main body with a side surface that is axisymmetric about a central axis and an end surface through which the central axis extends, a pin having a first end and a second end, the pin fixed at the first end to the end surface and protruding cantilevered in an axial direction relative to the central axis, the pin being completely offset relative to the central axis, and an enlarged tip located at the second end of the pin; and a socket having a cup-shaped cavity delimited by a lateral wall open at a first end and closed by a bottom wall at a second end opposite the first end, wherein the lateral wall defines a complimentary internal surface for mating with the main body of the plug, and wherein the bottom wall includes an external surface facing outside the cup-shaped cavity, a through hole positioned eccentrically with respect to the central axis such that the enlarged tip of the plug is configured to pass through the through hole and extend beyond the external surface upon the oil drain plug mating with the socket, and a slot departing from the through hole and extending towards a distal end along an arched path centered in the axis of the internal surface such that, after the enlarged tip of the plug the passes through the hole, the oil drain plug is configured for rotation such that the pin extends through the slot, the slot having a smaller width than a width of the through hole for preventing the enlarged tip of the plug from passing therethrough when the pin extends through the slot.

13. An oil sump assembly comprising an oil sump drain assembly according to claims 12 disposed within an oil sump.

14. An internal combustion engine comprising an oil sump according to claim 13.

* * * * *